US005983844A

United States Patent [19]

Hauder

[11] Patent Number: 5,983,844

[45] Date of Patent: Nov. 16, 1999

[54] CYLINDER HEAD WITH CAST COOLING WATER CHANNELS AS WELL AS METHOD AND CASTING CORES FOR PRODUCING SAME

[75] Inventor: Walter Hauder, Linz, Austria

[73] Assignee: VAW mandl & berger GmbH, Linz, Austria

[21] Appl. No.: 09/089,780

[22] Filed: Jun. 3, 1998

[30] Foreign Application Priority Data

Jun. 4, 1997 [DE] Germany ..... 197 23 343

[51] Int. Cl.[6] ..... F02F 1/36

[52] U.S. Cl. ..... 123/41.82 R

[58] Field of Search ..... 123/41.82 A, 41.82 R

[56] References Cited

U.S. PATENT DOCUMENTS

| | | | |
|---|---|---|---|
| 4,083,333 | 4/1978 | Rudert et al. | 123/41.82 R |
| 4,121,550 | 10/1978 | Wand et al. | 123/41.82 R |
| 4,377,990 | 3/1983 | Seidl | 123/41.82 R |
| 5,615,641 | 4/1997 | Koch et al. | 123/41.82 R |
| 5,890,461 | 4/1999 | Ikura | 123/41.82 R |

FOREIGN PATENT DOCUMENTS 28 39 199 C2 1/1983 Germany .

*Primary Examiner*—Willis R. Wolfe
*Assistant Examiner*—Brian Hairston
*Attorney, Agent, or Firm*—Harness, Dickey & Pierce, P.L.C.

[57] ABSTRACT

A cylinder head for a multi-cylinder internal combustion engine with a plurality of cylinder portions, each having gas changing channels, valve guides and bolt holes for one cylinder. The cylinder head is provided with a deck face designed to rest on a cylinder block. A valve drive pan is positioned opposite the deck face. Two longitudinally extending side faces and two end faces form the cylinder head. The cylinder head also has a cast longitudinal cooling water channel which extends along the plurality of cylinder portions. The longitudinal cooling water channel has cooling water entry and cooling water exit apertures designed to be connected to cooling water channels in the cylinder block. At least one cast transverse cooling water channel is provided for ventilating purposes and for discharging vapor bubbles. The transverse cooling water channel extends transversely to the longitudinal direction along the plurality of cylinder portions in an intermediate floor above the longitudinal cooling water channel. The cast transverse cooling water channel, at its one end close to a side face of the cylinder head, is connected to the longitudinal cooling water channel by a transfer aperture. At its other end opposed to the transfer aperture and close to the other side face, the transverse cooling water channel has a discharge member.

9 Claims, 2 Drawing Sheets

CYLINDER HEAD WITH CAST COOLING WATER CHANNELS AS WELL AS METHOD AND CASTING CORES FOR PRODUCING SAME

BACKGROUND OF THE INVENTION

The invention relates to a cylinder head casting for a multicylinder combustion engine with a plurality of cylinder portions. Each cylinder portion includes gas changing channels, valve guides and bolt holes for one cylinder. The cylinder head is provided with a deck face designed to rest on a cylinder block. A valve drive pan is positioned opposite the deck face. The cylinder head has two longitudinally extending side faces and two end faces. The cylinder head has a cast longitudinal cooling water channel which extends along the plurality of cylinder portions. The longitudinal cooling water channel includes cooling water entry apertures and cooling water exit apertures designed to be connected to cooling water channels in the cylinder block. Furthermore, the invention relates to a method of casting such a cylinder head casting and to a casting core suitable for carrying out the casting method.

In the case of engines subject to high loads due to increasing performance density, the formation of vapor bubbles constitutes a greater and greater problem in the cooling water system. The vapor bubbles must be avoided because of the deterioration in heat transfer and the resulting impermissible thermal stresses. In modern two valve, three valve, four valve or five valve engines, with 2, 3, 4 or 5 valves per cylinder, the problem is intensified as the longitudinal cooling water channel has more and more branches and clefts. Thus, portions are formed with a reduced cooling water flow speed, which encourage the formation of vapor bubbles.

A cylinder head casting is known from DE 28 39 199 C2. A longitudinal cooling water channel extends in the vicinity of a side face on the inlet gas channel side. Transverse cooling water channels are provided as bores. The bores are connected to niche-like water chambers which can be deformed from their cores after casting towards the separating plane between the cylinder head and cylinder block. The bores serve to ensure a defined flow of cooling water.

SUMMARY OF THE INVENTION

It is an object of the present invention to provide a cylinder head casting which comprises means acting against the formation of vapor bubbles. Furthermore, it is an object of the invention to provide a suitable method of producing such means.

The inventive cylinder head casting is provided with at least one cast transverse cooling water channel. The transverse cooling water channel is provided for ventilating purposes and for discharging vapor bubbles. The transverse cooling water channel extends transversely to the longitudinal direction of the plurality of cylinder portions in an intermediate floor above the longitudinal cooling water channel. The cast transverse cooling water channel, at its one end is connected to the longitudinal cooling water channel by means of a transfer aperture close to a side face of the cylinder head. A discharge means is provided at the transverse cooling water channels other end opposed to the transfer aperture and close to the other side face.

In an inventive cylinder head casting, at least one transverse cooling water channel is arranged halfway along the length of the cylinder head or in the rear cylinder head half when viewed in the direction of flow of the longitudinal cooling water channel. However, preferably each one of the cylinder portions comprises its own transverse cooling water channel. Thus, the thermal conditions of the cylinder portions are balanced.

The transverse cooling water channels make it possible, especially in each one of the individual cylinder portions, to discharge any vapor bubbles near their place of origin. A partial cooling water flow is returned directly to the cylinder block so that larger vapor bubble clusters cannot occur in the individual cylinder portions. In a preferred embodiment, each transverse cooling water channel is provided with a bent discharge portion. The bent discharge portion extends as far as the deck face. In this embodiment, the discharge means ends at the deck face so that the respective partial cooling water flow can be returned via an inlet in the respective counter face of the cylinder block. However, it is also possible for the discharge means to end at the side face and for the discharge means to return by means of an outer pipe into the cylinder block or directly to the radiator.

According to a preferred embodiment, the longitudinal cooling water channel, in the region of each transfer aperture leading to a transverse cooling water channel, forms a dome. The dome, a bell-shaped widened portion, facilitates the transport of any vapor bubbles even at low flow speeds of the partial cooling water flow and with small cross-sections of the transverse cooling water channel.

According to a further embodiment, the cross-section of the respective discharge portion is greater than the cross-section of the portion of the transverse cooling water channel extending in the base of the valve drive pan and in the intermediate floor, respectively. In this way, the sealing face towards the cylinder block is optimized with respect to web widths and surface pressure.

Furthermore, the transfer aperture between the longitudinal cooling water channel and a transverse cooling water channel is formed by a bore in the cylinder head. A plug or cover is inserted into the open end of the bore emerging from the cylinder head. Thus, the two types of cooling water channel can be produced more easily from a casting-technical point of view. Thus, the transfer apertures can be dimensioned more accurately.

It can be advantageous to guide the discharge means of the transverse cooling water channel closely along the air intake channels, which carry expanded cooled inlet air. In this way, the cooling water carrying vapor bubbles is cooled and then the bubbles are condensed.

For cylinder heads whose inlet and outlet channels in each cylinder portion are disposed transversely relative to the longitudinal direction on both longitudinal sides, i.e. for an assembly such as it is always used in multi-valve engines, the transfer aperture is positioned on the side of the outlet gas channels and the discharge means on the side of the inlet gas channels. In this way, any vapor bubbles which may develop are discharged from the longitudinal cooling water directly at their place of origin on the hotter side of the cylinder head.

Furthermore, in cylinder heads with two or more inlet valves and two or more outlet valves per cylinder portion, the transverse cooling water channels extend between two transversely disposed valve guiding bores and two transversely disposed cylinder head bolt holes. In this way, the transverse cooling water channels can be arranged as close as possible to the center of the combustion chambers.

The inventive method of producing a cylinder head casting includes the transverse cooling water channels and the longitudinal cooling water channel being cast without being connected to one another. The transfer apertures are each produced by a bore. The outer ends of the bores are closed by a plug or cover.

The bores are preferably produced so as to start from a side face of the cylinder head. However, the bore may also start from the base of the valve drive pan. In this case, the bore enters the separating wall between the two cast channels approximately perpendicularly and can thus be accurately dimensioned.

As already mentioned, the bent discharge means can either emerge from the deck face in a cast condition or the discharge means can emerge in a cast and/or bored condition from the cylinder head side face opposed to the above-mentioned cylinder head side face.

A casting core to produce the cast transverse cooling water channels has the shape of a knee bend with core supports and core marks in the form of longitudinal extensions of the two legs. The core mark starting at the horizontal portion can be placed on a core mark of an outlet gas channel or it may be supported on a core mark support extending upwards from the bottom part of the casting die. The core mark at the end of the discharge means can be centered and positioned in the base of the casting die by means of a female core mark.

From the following detailed description, taken in conjunction with the drawings and subjoined claims, other objects and advantages of the present invention will become apparent to those skilled in the art.

BRIEF DESCRIPTION OF THE DRAWINGS

Further details will be explained with reference to the drawings wherein.

DETAILED DESCRIPTION OF THE PREFERRED EMBODIMENT

Figure 1:
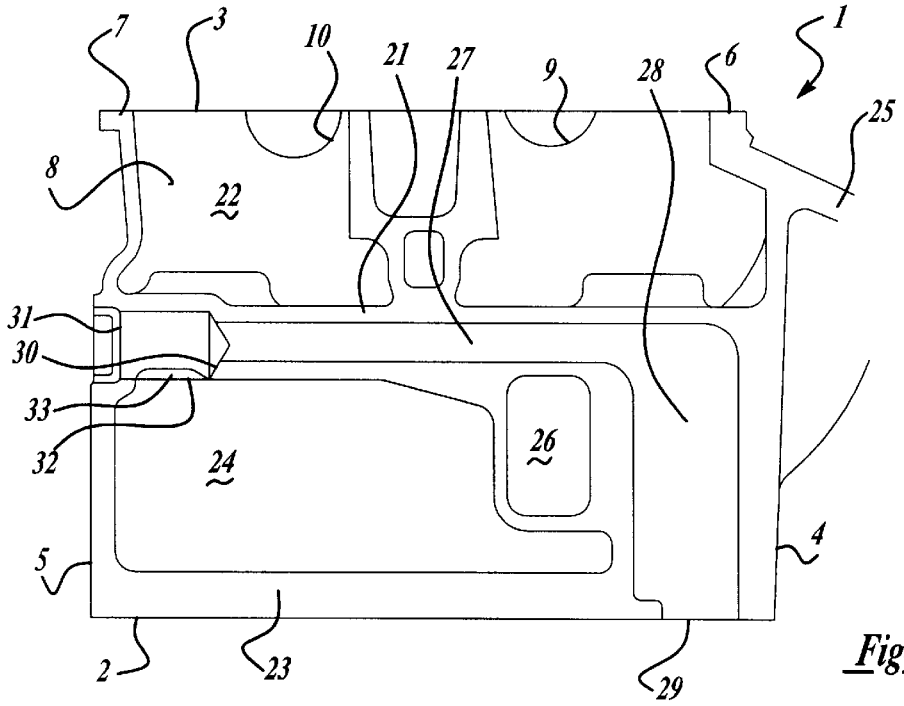
FIG. 1 is a vertical cross-section view of the inventive cylinder head through a transverse cooling water channel along the sectional line according to FIG. 2.
Figure 2:
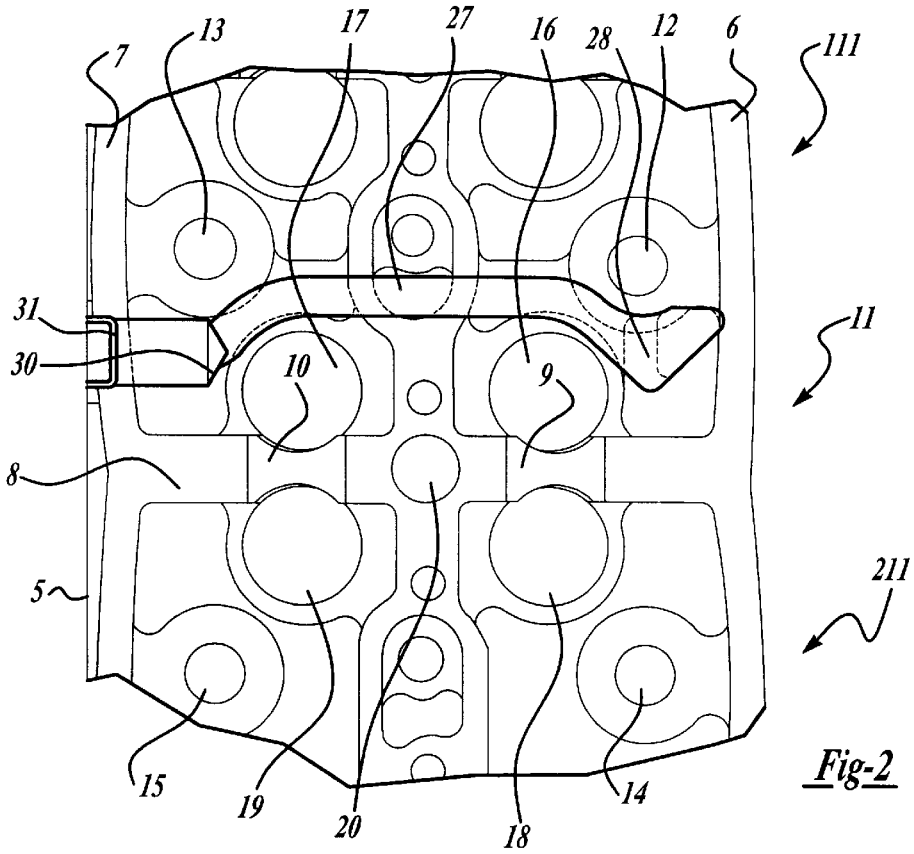
FIG. 2 is a plan view of the cylinder portion according to FIG. 1.

FIGS. 1 and 2 will be described jointly below. The cylinder head 1 has a deck face 2 which is sealingly placed onto a cylinder block. A cover face 3 has webs and onto which there is placed a cover. Adjoining the deck and cover faces are side faces 4, 5. The webs include longitudinal webs 6 extending along the side face 4 which constitutes the inlet side. Longitudinal webs 7 extend along the longitudinal side 5 which constitutes the outlet gas channel side. Transverse webs 8 connect the longitudinal webs 6, 7 transversely relative to the longitudinal direction. The transverse webs 8 include recesses 9, 10 which are formed to receive camshaft bearings.

A cylinder portion 11 of the cylinder head 1 is delimited by the bore centers of bolt holes 12, 13, 14, 15. A further cylinder portion 111 and a cylinder head end portion 211 follow the cylinder portion 11 in the longitudinal direction. Inside the bolt holes, valve tappet pockets 16, 17, 18, 19 are provided. The pockets 16, 18 are provided for inlet valves and the pockets 17, 19 are provided for outlet valves. In the center between the valve tappet pockets a bore 20 is provided for an injection nozzle. The axes of the valve guiding bores and of the nozzle bores are indicated by dashed lines.

In approximately the center between the side faces 4, 5 a horizontally extending intermediate floor 21 is provided. The floor 21, together with the webs 6, 7, forms the upwardly open valve drive pan 22. The floor 21 together with a lower deck wall 23 of the cylinder head forms a longitudinal cooling water channel 24. The longitudinal cooling water channel 24 is closed on all sides. The longitudinal cooling water channel 24 at the cylinder portions at the outer end is delimited by end walls of the cylinder head.

An air intake channel 26 adjoins the longitudinal cooling water channel 24. The air intake channel 26 is partially positioned underneath the intermediate floor 21 and extends from a side entry neck 25 to the deck face 2.

A transverse cooling water channel 27 is positioned above the longitudinal cooling water channel 24 and the air intake channel 26. The transverse cooling water channel 27 is formed in the intermediate floor 21 and changes into a substantially vertically extending discharge or end portion 28. The discharge portion 28 is provided with an exit aperture 29 in the deck face 2.

On the outlet side, the transverse cooling water channel 27 is widened by a bore 30. The bore 30 is outwardly closed by a pressed-in cover 31. The bore diameter of the bore 30 is large enough to guarantee the longitudinal cooling water channel to be cut into and for a transfer aperture to be obtained.

The transfer aperture 32 is provided in a portion in which the longitudinal cooling water channel 24 forms a dome 33. Any vapor bubbles occurring in the longitudinal cooling water channel 24 are thus able to collect in the dome 33. The vapor bubbles move through the transfer aperture 32 via the transverse cooling water channel 27. The vapor bubbles are discharged into the cylinder block by a quantity of cooling water returning into the discharge portion 28.

Because of the proximity of the air intake channel 26, into which flows expanded and cooled intake air, the cooling water is cooled, as a result of which, even in this portion, any vapor bubble which may have formed in the transverse cooling water channel 27 are condensed. In a plan view, the transverse cooling water channel 27 extends meander-like between two respective bolt holes 12, 13 and two respective valve tappet pockets 16, 17 as seen in FIG. 2.

Figure 3:
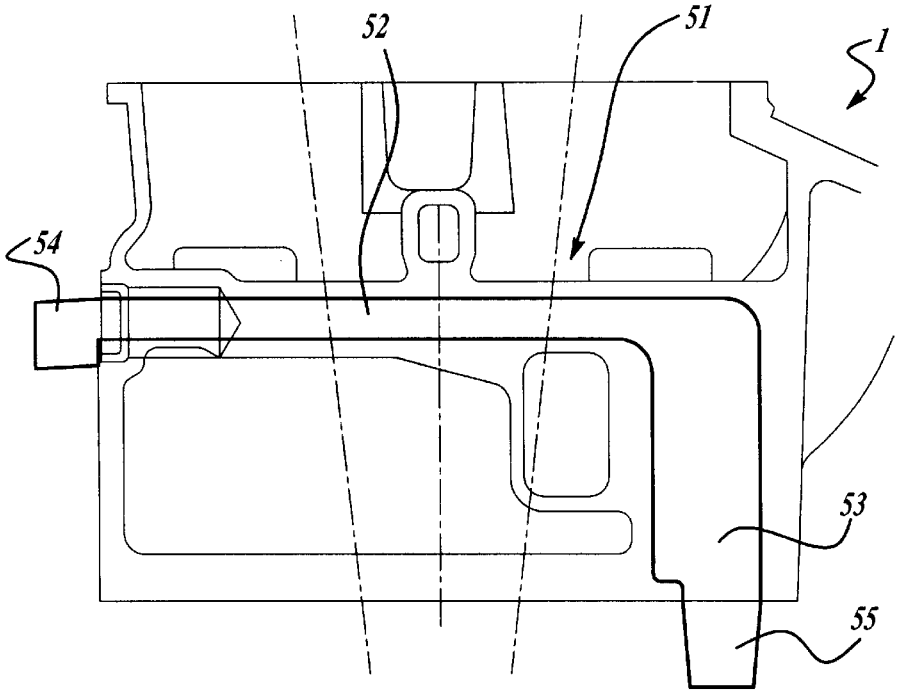
FIG. 3 is a cross-section view like FIG. 1 with a casting core.
Figure 4:
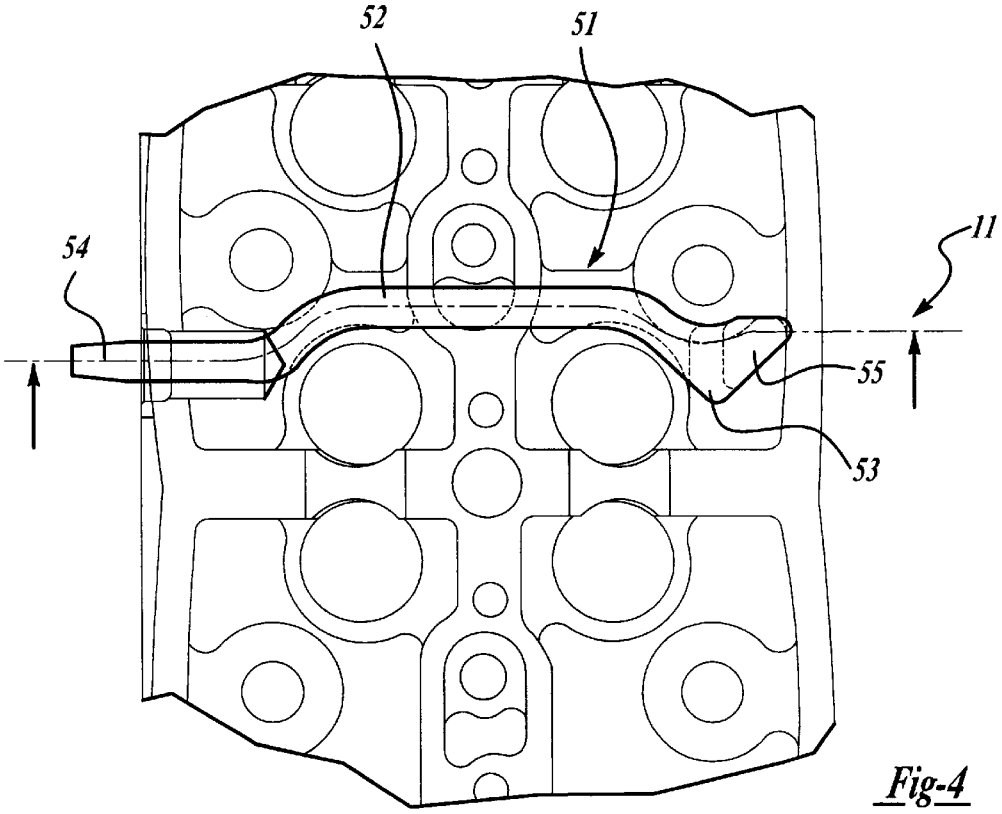
FIG. 4 is a view like FIG. 2 with the inventive casting core in a cylinder portion.

FIGS. 3 and 4 will be described jointly below. The cylinder head details are not referred to individually. However, they are shown in the same way as in FIGS. 1 and 2. The transverse cooling water channel is formed by a casting core 51 with a transverse leg 52 and a vertical leg 53. The shape corresponds to the finished transverse cooling water channel with the exception of the widened bore. The core thus does not overlap with the longitudinal cooling water channel. At the end of the transverse leg 52, a core mark 54 is arranged which can be supported on a core mark of a core for a gas outlet channel or on a core mark support extending upwardly from the die base. A core mark 55 is formed at the end of the vertical leg 53. The core mark 55 can be inserted into a female core mark in the die base.

While the above detailed description describes the preferred embodiment of the present invention, the invention is susceptible to modification, variation and alteration without deviating from the scope and fair meaning of the subjoined claims.

What is claimed is:

1. A cylinder head casting for a multi-cylinder internal combustion engine with a plurality of cylinder portions, each cylinder portion comprises gas changing channels, valve guides and bolt holes for one cylinder, said cylinder head having a deck face for resting on a cylinder block, a valve drive pan positioned opposite the deck face, two longitudinally extending side faces and two end faces, and a cast longitudinal cooling water channel in said cylinder head extending along the plurality of cylinder portions, said longitudinal cooling water channel including cooling water entry apertures and cooling water exit apertures designed to be connected to cooling water channels in the cylinder block; and at least one cast transverse cooling water channel in said cylinder head for ventilating and for discharging vapor bubbles, said at least one transverse cooling water channel extending transversely to the longitudinal direction along the plurality of cylinder portions in an intermediate floor above the longitudinal cooling water channel, said at least one cast transverse cooling water channel, at one end close to one of said two side faces of the cylinder head, is connected to the longitudinal cooling water channel by a transfer aperture and, at an other end of said transverse cooling water channel opposed to the transfer aperture and close to the other side face, has a discharge means.

2. A cylinder head casting according to claim 1, wherein said transverse cooling water channel has a bent discharge portion which extends as far as the deck face.

3. A cylinder head casting according to claim 1, wherein each cylinder portion has one cast transverse cooling water channel.

4. A cylinder head casting according to claim 1, wherein said at least one longitudinal cooling water channel, in the region of said transfer aperture, respectively forms a dome having a bell-shaped widened portion.

5. A cylinder head casting according to claim 1, wherein the cross-section of the respective discharge portion is greater than the cross-section of the portion of the transverse cooling water channel extending in the intermediate floor.

6. A cylinder head casting according to claim 1, wherein the transfer aperture is formed by a bore in the cylinder head.

7. A cylinder head casting according to claim 6, wherein at one end of the bore in an outer wall of the cylinder head a plug or a cover is inserted into said bore.

8. A cylinder head casting according to claim 1, with gas inlet and gas outlet channels provided in each cylinder portion and disposed transversely to the longitudinal direction, wherein each transfer aperture is positioned on the side of the gas outlet channels and each discharge means is positioned on the side of the gas inlet channels.

9. A cylinder head according to claim 1, with two gas inlet channels and two gas outlet channels in each cylinder portion, wherein said at least one transverse cooling water channel extends between two valve guides disposed transversely to the longitudinal direction and two bolt holes disposed transversely to the longitudinal direction.

* * * * *